United States Patent [19]

Switzer

[11] 3,973,733

[45] Aug. 10, 1976

[54] METHOD AND APPARATUS FOR COMMINUTION OF COAL AND OTHER MATERIALS TO ULTRAFINE SIZES

[75] Inventor: George W. Switzer, Midlothian, Va.

[73] Assignee: Gilbert Associates Inc., Reading, Pa.

[22] Filed: Sept. 13, 1974

[21] Appl. No.: 505,677

Related U.S. Application Data

[63] Continuation-in-part of Ser. No. 327,874, Jan. 29, 1973, abandoned.

[52] U.S. Cl. ..... 241/1; 241/5; 241/39; 241/301

[51] Int. Cl.[2] ..... B02C 19/00

[58] Field of Search ..... 241/1, 5, 18, 39, 301

[56] References Cited

UNITED STATES PATENTS

| | | | |
|---|---|---|---|
| 2,515,541 | 7/1950 | Yellott | 241/39 |
| 3,545,683 | 12/1970 | Schulte | 241/5 X |
| 3,688,991 | 9/1972 | Andrews | 241/39 X |

*Primary Examiner*—Granville Y. Custer, Jr.
*Attorney, Agent, or Firm*—William J. Ruano

[57] ABSTRACT

Apparatus and a method of comminuting coal to about 1 to 10 microns size comprising introducing the coal particles into a plurality of vessels, each of which is subjected to high pressure, superheated steam which infuses into the pores of said particles equalizing the pressure therein with that surrounding the particles in the vessel. By opening a discharge valve of each vessel connected to a nozzle leading into a housing, in which a paddle wheel is located, the particles will burst in each vessel to smaller size because of the reduction of the pressure therein surrounding the particles. Opening of said valve will effect acceleration, turbulence and collision of the particles to cause further breakage particularly as the particles are further expanded through the nozzle and against the blades of the paddle wheel driven in a direction opposite that of the nozzle jets. The vessel may be operated under partial vacuum by connection to a steam condenser through which cooling water flows.

4 Claims, 2 Drawing Figures

METHOD AND APPARATUS FOR COMMINUTION OF COAL AND OTHER MATERIALS TO ULTRAFINE SIZES

This invention relates to a method and apparatus for comminution of coal and other materials to ultra-fine sizes and is a continuation-in-part of application Ser. No. 327,874 filed Jan. 29, 1973, now abandoned.

The economics of comminution of materials is dependent upon the cost of the equipment required and its energy consumption. Well developed machinery is commercially available to reduce materials to a particle size in the order of 74 microns (200 mesh) with machinery and energy costs acceptable for most bulk operations and processes. Machinery is also available for reduction of particle size to approximately 1 to 10 microns but the higher equipment costs and energy consumption, per unit of material processed, limits its use to materials of higher value and lower quantities, such as pharmaceuticals, foodstuffs, and cosmetics. No proven technology exists for comminution of large quantities of low-value bulk materials to ultra fine sizes (1 to 10 microns) with satisfactory equipment and energy costs.

It is recognized that equipment and energy costs will be higher for comminution of materials from inch dimensions to ultra-fine sizes than from inch dimensions to pulverized sizes (order of 74 microns). However, a considerable gap exists between the currently available equipment capacities and energy consumptions. For example, equipment is available for grinding coal to 74 micron size in capacities up to 50 tons per hour and power consumption of about 20 kilowatt-hours per ton. For one of the methods of comminution to 1 to 10 microns, equipment is available having a capacity of about four tons per hour with steam and electric consumption equivalent to about 150 kilowatt hours per ton.

The advantages of the process and equipment system of the present invention can be seen by comparing it with methods currently available.

Equipment is currently available which utilizes one or more high speed bladed wheels and introduces the material at a low velocity into the path of the blades. This machine depends on the turbulence within the machine housing to cause multiple impingements and the speed of the wheel to break the particles. Such machines must compromise capacity and power consumption. Since the material particles are conveyed in suspension, there must be relative motion between the wheel and the mass of the fluid carrying the particles. This high relative motion results in high windage or fluid resistance power consumption. If the mass of fluid is permitted to move with the wheel, windage loss is decreased, but the number and velocity of impingements decrease and a given amount of material must remain in the path of the wheel longer in order to be reduced correspondingly in size of particles.

The method of the present invention substitutes the velocity of the jet for high velocity (and high windage loss) of the wheel. In addition, operation of the wheel in a partial vacuum results in a thin atmosphere and reduces windage loss appreciably.

Another type of equipment available expands steam through a nozzle and entrains material in the high speed jet to cause impingement against the walls of a vortex housing or in a more efficient version, against the blades of a rotating wheel. This latter version would require about 2 pounds of steam per pound of coal reduced from 74 microns to 1 to 10 micron particle size. In addition, the rotating wheel incurs windage loss. The steam consumption represents about 16% of the calorific value of the fuel.

By contrast, the system of the present invention can achieve the same velocity of the mixed jet with less than 0.1 pound of steam per pound of coal with windage of the wheel virtually eliminated. This enables higher wheel speed and impingement relative velocity without significant windage losses.

A third type of equipment available places the material to be comminuted in a vessel under a fluid pressure and expands the mixture through a quick-opening valve into a chamber wherein opposing such streams are impinged against one another. Impingement against machine elements is not employed and the underlying principle of comminution is that of shock wave stresses caused by sonic velocity of the jet of steam and material. It is evident that the effect of internal stress by differential pressure in porous material will also be achieved, but the method does not insure that each particle will be subjected to impingement stress while the particle is subjected to internal pressure stress. In addition, achievement of sonic velocity dictates the steam pressure which must be mixed with the material before pressure release. Since the method proposed herein does not depend on sonic velocity, lower steam pressure can be used and for a given weight and volume of material, a lower weight of steam.

In addition to reducing windage power consumption of the wheel, the existence of a vacuum in the wheel housing has other advantages and permits other options in the mode of operation.

It is an object of the present invention to solve the abovementioned problem by providing a novel method and apparatus which will combine basic effects to reduce the energy necessary to comminute materials to ultra-fine sizes as compared to current technology.

Other objects and advantages will become more apparent from a study of the following description taken with the accompanying drawing wherein.

Figure 1:
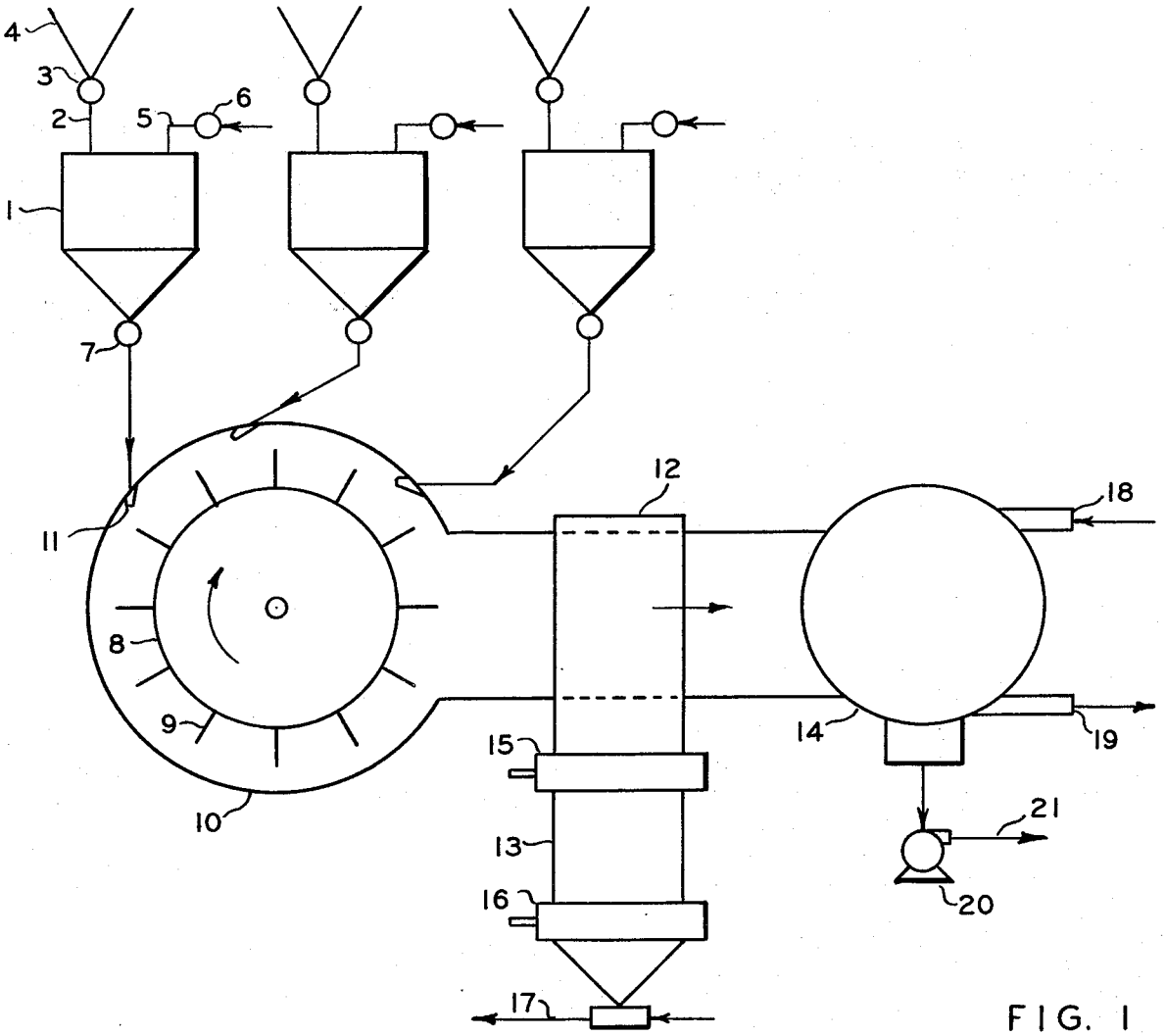
FIG. 1 is a schematic view of apparatus for comminuting coal and embodying the principles of the present invention.

Referring more particularly to the drawing, numeral 1 denotes a vessel into which prepulverized or ground material, such as coal, can be introduced. This vessel is equipped with an inlet pipe connection 2 with valve 3 for introduction of the material from bin 4. An inlet pipe connection 5 with valve 6 is provided for the introduction of superheated steam and an outlet connection with a quick-opening valve 7 is provided for egress of the steam and material charge. While three of such assemblies are shown, any other number may be used instead and operated sequentially.

A motor-driven rotating wheel 8 has flat plates 9 projecting from its periphery. The wheel rotates within a housing 10 which has one or more fixed nozzles 11 to direct the emission material and steam from the vessel 1 against the flat plates of the wheel and counter to their direction of travel indicated by the arrow.

A separator and/or filter 12, in the path of the steam exiting from the wheel housing, separates the coal particles from the steam, which particles drop into lock hopper 13 which eventually enter into the process line 17.

Optionally, the steam leaving the wheel housing and filter may be conducted to a water cooled condenser 14 cooled by water in pipes 18, 19 to condense the steam and create a vacuum in the wheel housing and filter.

The operation of the system for comminution of material, for example coal, is as follows:

The coal inlet valve 3 to the vessel 1 is opened and prepulverized or crushed coal is allowed to flow into the vessel.

The coal inlet valve 3 is closed and the steam inlet valve 6 is opened, thus placing the coal in the vessel in an atmosphere of high pressure superheated steam. Pressurizing the material with steam will cause pressure steam to infuse into the pores of the coal equalizing pressure in the pores with that surrounding the particle.

The steam inlet valve 6 of the vessel is closed then the quick opening valve 7 is opened. When the pressure surrounding the particle is suddenly reduced by opening the quick opening valve, the decay in the pressure surrounding the particles within a fraction of a second will result in a higher pressure within the particle than that outside the particle with a resultant stress tending to burst the particle into two or more pieces depending on the number and depth of the pores. This tensile stress effect would not apply to non-porous materials.

The steam in the vessel 1 expands through the outlet pipe and quick-opening valve 7 entraining and accelerating the coal in the vessel. Accelerating the particles by expansion of the steam will cause turbulences and collisions of particles with one another. This will cause breakages of particles to occur.

The steam and coal mixture are accelerated further in expanding through the nozzle 11 of the rotating wheel housing 10. The nozzle 11 directs the high velocity stream against the plates on the periphery of the rotating wheel 8. Impingement of particles moving at high velocity relative to the plates of the wheel will cause breakages to occur.

After direct impingement of the jet and additional casual impingements on the plates 9, the mixture of steam and comminuted coal flows through a separator and/or filter 12. The coal falls into a lock hopper 13 having slide gates 15, 16. The steam passes through the separator/filter 12 and is exhausted to atmosphere through suitable final filters or cleaners or is cooled and condensed in a heat exchanger 14. Pump 20 pumps condensate at 21 to a coagulator and sand filter. Ultrafine coal at 17 is fed to a process.

The advantages of the system are that it combines three effects, each of which might be separately and singly used for comminution.

It can be seen that a tensile stress from pressurizing the material by steam, as described above, which would not be adequate to break a particle and an impingement stress from either accelerating the particles by steam or by impingement of the particles against the plates of the wheel which likewise would not break the same particle might, when combined, result in breakage of the particle.

Firstly, the vacuum permits a lower pressure to be used in the pressure vessel for a given velocity to be achieved by the jet of steam and coal issuing from the nozzle when the quick-opening valve is opened. This lower steam results in a lower weight of steam in the pores, interstices between coal particles, and free space in the vessel.

Secondly, the lower steam pressure has a lower saturating steam corresponding, therefore allows a lower superheated steam temperature to be used and still avoid moisture formation in the vessel. This feature is important where it is desired to avoid devolatilizing the coal.

Softening of bituminous coal will begin at a temperature of about 400°F. and active devolatilization will begin at about 500°F. Thus for best comminution it would be best to limit the superheated steam temperature to a maximum of 400°F. Saturated steam temperatures corresponding to some finite steam pressures are:

Atmospheric Pressure- 212°F.
15 psi gauge 250°F.
100 psi gauge 338°F.
150 psi gauge 366°F.

Thus typical operation of the present invention would be with steam at 100 psi gauge and a temperature of 375°F. thus providing both a margin of superheat to avoid water condensation in the vessel and a margin against softening the coal which would result in poorer comminution.

It is recognized that, if the steam temperature were high enough to result in devolatilization to any appreciable degree, a potential danger would occur in the vacuum space in the housing if air inleakage were allowed to occur. The volatile combustible gases evolved from the coal when mixed with such air could form an explosive mixture. It is inevitable that a spark would occur in the wheel housing and ignite such an explosible mixture. Thus, if steam pressure were selected high enough to cause any devolatilization of the coal, either vacuum operation must be avoided or air inleakage scrupulously prevented.

If a devolatilization mode is selected along with vacuum operation, the volatile combustible gases would be removed by the apparatus commonly used with vacuum condensers to remove non-condensable gases from such condensers. This gas could then be sent via pipes to process or fuel uses or to an accumulator.

A mode of operation might be selected wherein a high steam temperature (appreciably over 400°F.) is used so that an appreciable degree of devolatilization of the coal is performed deliberately at some expense in the efficiency of comminution. However, as long as the steam used in the vessel were below about 650°F., agglomeration of coal particles should not occur. With the reduction in steam and particle temperature that occurs due to acceleration of the jet in the nozzle, a satisfactory degree of comminution is obtained for some purposes, such as producing activated carbon for water treatment impurity and selective gaseous absorptions.

The mode of operation featuring low steam pressure and temperature and vacuum in the impingement wheel housing and maximum efficiency of comminution would be particularly suitable for producing micron size feed material for the processes cited in Patent Application Ser. No. 327,877, now U.S. Pat. No. 3,854,666, issued Dec. 17, 1974, and Patent Application Ser. No. 327,873, now Patent No. 3,854,896, issued Dec. 17, 1974, which require micron size particles with the volatile content retained therein.

Another mode of operation possible is the use of higher steam pressure and temperature in the vessel and a positive pressure in the wheel housing and condenser space. In this mode, the condenser would still serve to separate the steam by condensation at above atmospheric pressure and temperature above 212°F. In this mode, the volatile gases would flow under its own pressure, that is, without removal equipment to low pressure process or fuel use, to pressure boosting equipment, or to an accumulator. In this case, extreme care against air inleakage would be unnecessary, but caution against volatile gas outleakage would be necessary in the environs of the wheel housing and condenser.

Figure 2:
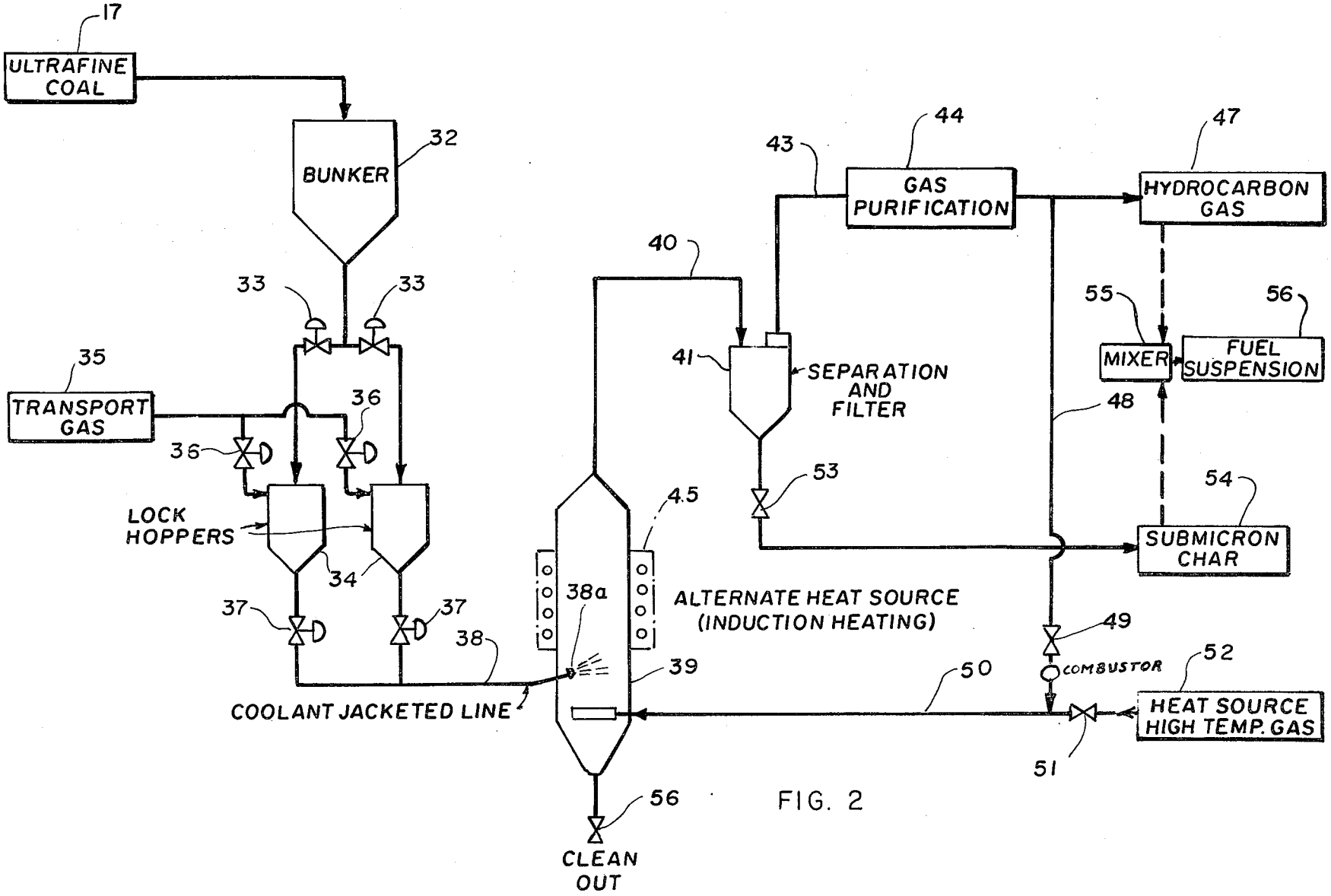
FIG. 2 is a schematic view of apparatus for treating the ultrafine coal produced by the apparatus of FIG. 1.

FIG. 2 of the drawing shows a typical application for the ultrafine coal 17 of FIG. 1. Ultrafine coal 17 is fed to a bunker 32, thence through valves 33 to lock hoppers 34. Also fed into lock hoppers 34 is a transport inert gas 35, such as, for example, helium, nitrogen or other oxygen-free gas such as argon. The combination of ultrafine coal and gas is fed through valves 37 to a coolant jacketed line 38 surrounded by cooling water or the like so as to bring the mixture to a low temperature before being fed through a nozzle 38*a* into the reactor 39. The reactor 39 is rapidly heated to high temperature, about 700° to 1000°C, such as by heating its walls whereby the inert gas is heated by convection and radiation from hot walls, or heating by an induction coil 45, or from a heat source 52 of high temperature inert gas, such as enumerated above, which flows through valve 51 and conduit 50 into reactor 39.

Within reactor 39, as the result of rapid heating, there occurs the simultaneous reduction of gaseous hydrocarbons and submicron carbon particles. The ultrafine coal particles will burst or explode to provide extremely small particles of about 1/100 microns. Most of the larger particles will be deposited and removed by a clean out 56 while most of the lighter particles will pass upwardly through conduit 40, separator and filter 41 so as to separate the submicron particles which are passed through valve 53 in the form of submicron char 54. The separated hydrocarbon gas passes through pipe 43 and gas purification apparatus 44 and provides a source of hydrocarbon gas 47 which can be mixed in mixer 55, in suitable proportions, with submicron char 54 to provide medium quality gaseous fuel suspension 56 which is particularly suitable as a fuel in industrial plants.

As described above, under the proper conditions, feeding ultrafine coal particles into the reactor 39 in which rapid heating occurs, there is simultaneous production of gaseous hydrocarbons and submicron carbon particles. During this carbonization the organic sulfur contained in the coal is converted to hydrogen sulfide which can be removed from the gas stream with relative ease.

The above described process produces a sulfur free, low, to medium BTU gas and low sulfur, submicron char particles by devolatilizing and comminution. The submicron particles could readily be entrained in the low BTU gas and could be transported through a gas pipeline. The gas and the char could be blended in proportions to yield a clean burning fuel of the desired heating value.

Relatively pure submicron carbon particles 54 could also be a by-product or even a main product of this process.

Since this process involves primarily the explosive devolatilization of the ultrafine coal, the process is highly efficient with respect to coal utilization. The devolatilization reaction is exothermic and only a small fraction of the heating value of the coal need be consumed in maintaining the proper thermodynamic conditions.

Thus it will be seen that the method and apparatus of FIG. 1 for comminution of coal and other materials may be used for producing a source of fuel 56 or simply submicron char 54, dependent upon the ultimate product desired. It should be noted however that the application illustrated in FIG. 2 is only one of many applications for which ultrafine coal 17 may be used. Similarly the application illustrated in FIG. 2 may derive its ultrafine coal source 17 from other methods and apparatus than that described in FIG. 1.

It will be seen from the above description that I have provided a highly efficient method and apparatus for comminution of coal to either ultrafine size or submicron size or both, which method and apparatus is relatively compact and involves a minimum of expenditure of power as compared to previous methods for comminution.

While I have illustrated and described several embodiments of my invention it will be understood that these are by way of illustration only and that various changes and modifications may be contemplated in my invention and within the scope of the following claims.

I claim:

1. The method of comminuting porous particles, such as coal, to ultra-fine size of the order of about 1 to 10 microns, comprising introducing said particles into a vessel, subjecting the interior of the vessel to high pressure superheated steam which infuses into the pores of said particles and equalizes the pressure in the pores with that surrounding the particles within said vessel, suddenly reducing the pressure surrounding said particles in said vessel so as to effect higher pressure in the pores than in the vessel space surrounding said particles, resulting in bursting of the particles, and expanding said steam by opening outlet means of said vessel and passing the steam and coal particles into a housing through a plurality of nozzles leading into the interior of said housing and positioned along spaced peripheral points thereof so as to discharge the steam and coal particles against the blades of a paddle wheel driven therein but in a direction opposite to that in which said wheel is driven so as to effect further breakage of said particles from expansion and collision through said nozzle means as well as further breakage from collision with the blades of said paddle wheel to provide particles of ultra fine size which are discharged from said housing into a separator from which the broken particles are discharged.

2. The method recited in claim 1 wherein the steam emerging from said separator is passed through and cooled and condensed in a heat exchanger.

3. Apparatus for comminuting porous particles, such as coal, to ultra fine size, comprising a housing, a paddle wheel driven in said housing by a source of power, a plurality of nozzles extending through said housing and directed to the blades of said paddle wheel in a direction opposite to that in which said wheel is driven, a plurality of vessels, each connected to one of said nozzles through a quick opening valve, a source of said particles connected through an inlet valve to each of said vessels, a source of superheated steam connected to each of said vessels through a valve, and a separator for separating said particles from the steam discharged from said vessel.

4. Apparatus as recited in claim 3 together with a heat exchanger into which steam from said separator is cooled and condensed.

* * * * *